US005762564A

United States Patent [19]

Schang

[11] Patent Number: 5,762,564

[45] Date of Patent: Jun. 9, 1998

[54] GOLF PUTTER ALIGNMENT DEVICE

[76] Inventor: Donald C. Schang, 5427-20th Ave., North, St. Petersburg, Fla. 33710

[21] Appl. No.: 846,584

[22] Filed: Apr. 21, 1997

[51] Int. Cl.[6] ..... A63B 69/36

[52] U.S. Cl. ..... 473/238

[58] Field of Search ..... 473/238, 268

[56] References Cited

U.S. PATENT DOCUMENTS

| | | | |
|---|---|---|---|
| 3,273,892 | 9/1966 | Nolting | 473/238 |
| 3,424,462 | 1/1969 | Driscoll | 473/238 |
| 4,949,971 | 8/1990 | Thornton | 473/238 |

*Primary Examiner*—George J. Marlo
*Attorney, Agent, or Firm*—Ronald E. Smith

[57] ABSTRACT

A golf putter alignment device includes a torsion spring clamp that firmly but releasably engages a shaft or a hosel of a golf putter. An elongate positioning rod is disposed within an elongate groove formed in a first arm of the clamp, and a transversely disposed end of a torsion spring overlies the elongate positioning rod to retain it within the elongate groove while allowing the elongate positioning rod to be slideably and rotationally disposed within the elongate groove for positioning purposes. A transversely disposed cradle is secured to a leading end of the elongate positioning rod and receives and supports an elongate alignment rod. The elongate alignment rod is slideable along its longitudianl axis within the cradle, the elongate positioning rod is slideable and rotatable along and about its longitudinal axis, respectively, within the elongate groove, and the clamp is rotatable about the longitudinal axis of the golf putter shaft or hosel so that the respective positions of those parts are adjustable with respect to one another.

5 Claims, 3 Drawing Sheets

Fig. 5C
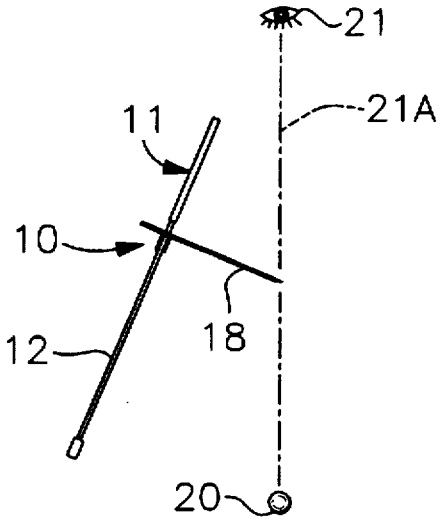
Fig. 5B
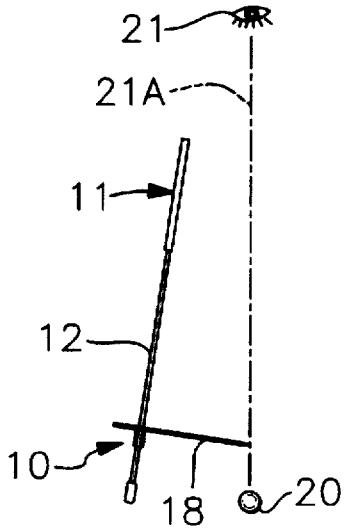
Fig. 5A
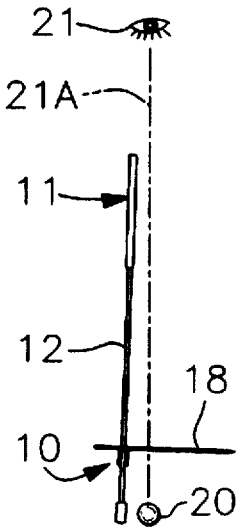
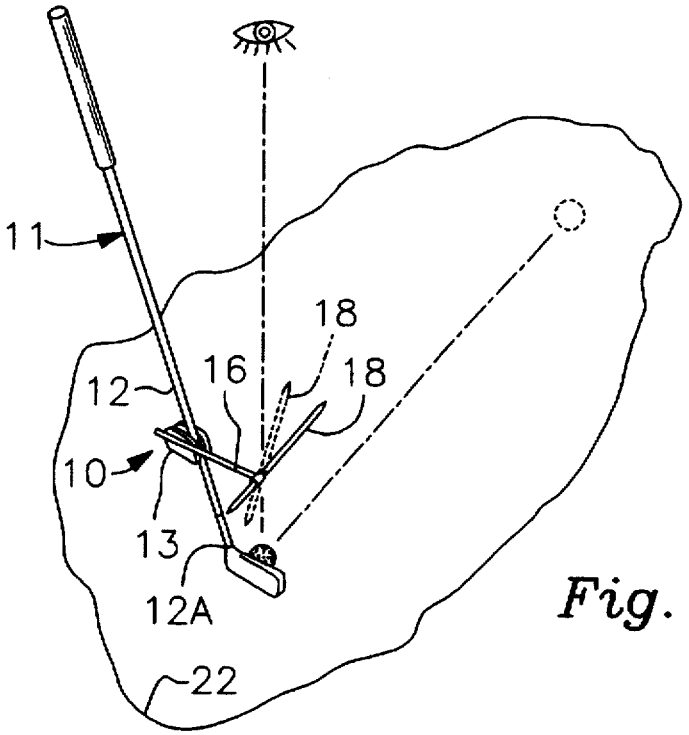
Fig. 6

GOLF PUTTER ALIGNMENT DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFISCHE APPENDIX

Not applicable.

BACKGROUND OF THE INVENTION

This invention relates to a golf putter practice device to enable a golfer to align a putter with the intended path of a golf ball and to aid in perfecting, a putting stroke.

Prior devices that have been proposed to aid in the sighting and aligning a putter head with the intended path of the golf ball have had various shortcomings. In the putter pointer of U.S. Pat. No. 4,002,343, the device is difficult to attach to the putter and is limited to use with blade type putters. In U.S. Pat. No. 3,667,761, the alignment device is built into a specialty designed putter and is limited to use with that particular putter. Most golfers would prefer a device that can be used with any putter that they may select. In U.S. Pat. No. 4,789,158, the base head is mounted in front of the shaft which may interfere with the visual alignment of the putter pointer. Additionally, the base head clamping design limits the mounting locations on the putter shaft and requires a cumbersome screw adjustment to position the alignment pointer over the "sweet spot" of the putter face.

BRIEF SUMMARY OF THE INVENTION

The objects and advantages of my invention are to provide a putter aligning and sighting device that has the following features:

(A) Light weight construction, out of plastic material, that will not affect the feel or stroke of the putter.

(B) Portable design that can easily be carried in a golf bag.

(C) Easy to attach, use, and remove from any type or design of golf putter.

(D) A practice device that can be used indoors or outdoors on a real putting green.

(E) Easy to adjust components in order to provide the best possible alignment configuration.

(F) A clamp design that allows the device to be located securely at any position on the rear side of the putter shaft.

(G) A long pointer that provides an accurate sighting guide along the intended path of the golf ball.

(H) A device that shows the golfer any deviation from the desired putting stroke which is keeping the pointer centered over the golf ball during the backstroke and the forward stroke of the putt.

(I) A device that allows a golfer to keep his eyes centered on the golf ball during the putting stroke.

(J) A device that, by changing its position on the putter shaft, allows the pointer to remain over the golf ball for both long or short backstrokes.

(K) A device that, with continued use and practice, will help a golfer improve his putting stroke.

When using this device to aid in aligning and developing a better putting stroke, a golfer has to simply attach the clamp to his putter shaft slide the positioning rod with the pointer attached to a location centered over the "sweet spot" of the putter and at a 90 degree right angle to the putter face. To practice and perfect a good putting stroke, the golfer keeps the pointer centered over the middle of the golf ball during the backward movement of the putter and also during the forward movement of the putter. When properly executed, the putter face will contact the golf ball in the same position as originally aligned. The result is that with practice, a consistent putting stroke can be developed with improved results in making putts. Still further objects and advantages will become apparent from a consideration of the ensuing description and drawings.

BRIEF DESCRIPTION OF THE SEVERAL VIEWS OF THE DRAWING

FIG. 5 shows three pointer positions as viewed by the golfer. Illustration A shows the pointer, ball and club position at initial alignment. Illustration B shows the pointer position with a short backstroke and with the alignment device located at a low position on the putter shaft. The golfer can see both the ball and the alignment pointer over the ball. Illustration C shows a longer putting backstroke and how the pointer can still be aligned over the golf ball by moving the alignment device to a higher position on the putter shaft.

FIG. 6 is a perspective view like FIG. 1, depicting in dotted lines the position of the alignment pointer when the positioning rod is rotated about its longitudinal axis.

DETAILED DESCRIPTION OF THE INVENTION

Figure 1:
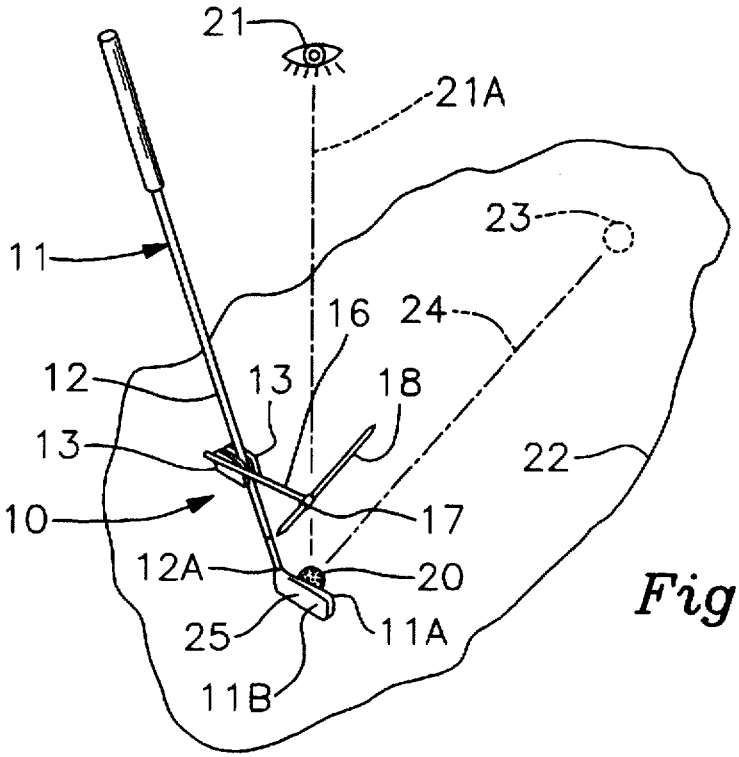
FIG. 1 shows an overall perspective view of the putter alignment device attached to the shaft of a typical putter. The alignment pointer is centered over the "sweet spot" of the putter face as viewed by the eye of the golfer and at a 90 degree angle to the putter face. Additionally, the pointer is aligned with the intended path of the ball toward the target hole.

The reference numeral 10 indicates generally the alignment and sighting device of this invention. As shown in FIG.

1. the device 10 is mounted on a blade style putter 11 which has an upright putting face 11A, and a blade style putting head 11B. The device 10 is shown secured at a lower position on the putter shaft 12 by the tension of the putter shaft clamp 13.

The preferred use of this invention is to attach the device 10 to the putter 11 at a position on the putter shaft 12 or hosel 12A that will allow the alignment pointer 18 to overlay the golf ball 20 during the desired length of the putting backstroke. Additionally, the golfer has the ability to center the alignment pointer 18, over the "sweet spot" 25 of the putter face 11B, by sliding the positioning rod 16 forward or rearward in the clamp 13 positioning rod guide 13A. When attached in the positioning rod pointer holder 17, the alignment pointer can be further adjusted to a 90 degree angle to the putting face 11A by rotating the clamp 13 on the putter shaft 12 or hosel 12A. After the initial setting has been made, the golfer can then place the putter head 11A behind the golf ball 20. Using his eye(s) 21, the golfer visually, sight line 21A, aligns the alignment pointer 18 along the intended path 24 on the putting surface 22 to the target 23.

To practice and perfect a golf putting stroke, the golfer aligns the device 10 as above. The preferred backstroke is to keep the alignment pointer 18 visually centered 21A over the ball 20 with the putter face 11A at a 90 degree angle to the direction of the putt 24. Any deviation of the putter face 11A will cause the alignment pointer to move off the desired line. The preferred forward stroke is to keep the alignment pointer 18, centered over the ball 20 and continuing to point toward the direction of the putt 24 with the club face 11A striking the ball 20 at the initial alignment position.

Figure 2:
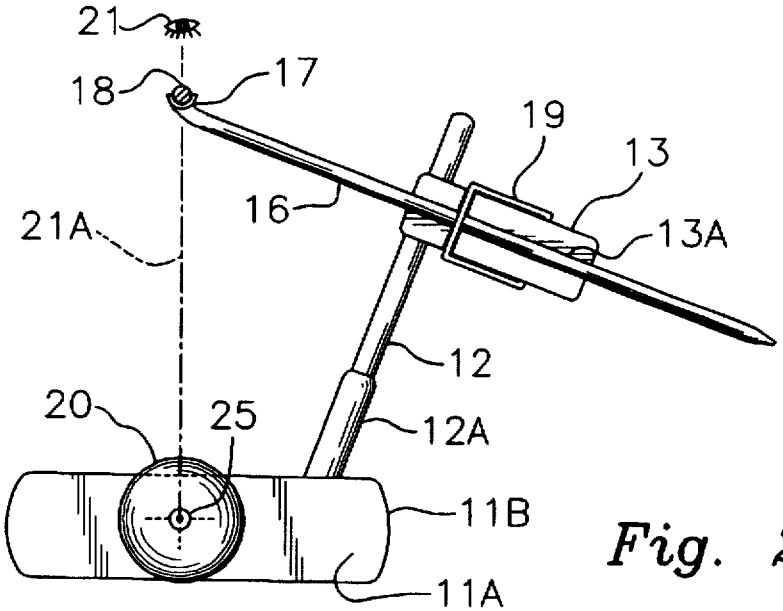
FIG. 2 shows a side view of the alignment device attached to the shaft of a typical putter. Additionally, it shows how the pointer is mounted in the positioning rod pointer holder and how the positioning rod is held in place by the torsion spring in the positioning rod guide along the side of the clamp. It should be noted that the positioning rod may be mounted on either the forward or rearward side of the clamp since both sides are identical.

Shown in FIG. 2 is the alignment device 10 mounted on the rear side of the putter shaft 12 along with the hosel 12A shown as part of the putter shaft and how the clamp 13 projects rearward in the opposite direction of the putter head 11B. This also shows the clamp 13 and how the torsion spring 19 overlaps the exterior side of the clamp 13 and also overlaps the positioning rod 16. Additionally, this view shows the alignment pointer 18 and how it fits snugly into the cradle-shaped alignment pointer holder 17 with the top of the alignment pointer being exposed to the golfers eye 21 and the projected sight line 21A to the "sweet spot" 25 on the putter head 11A and putter face 11B. Also shown is the preferred position of the golf ball 20 when using the alignment device 10.

Figure 3:
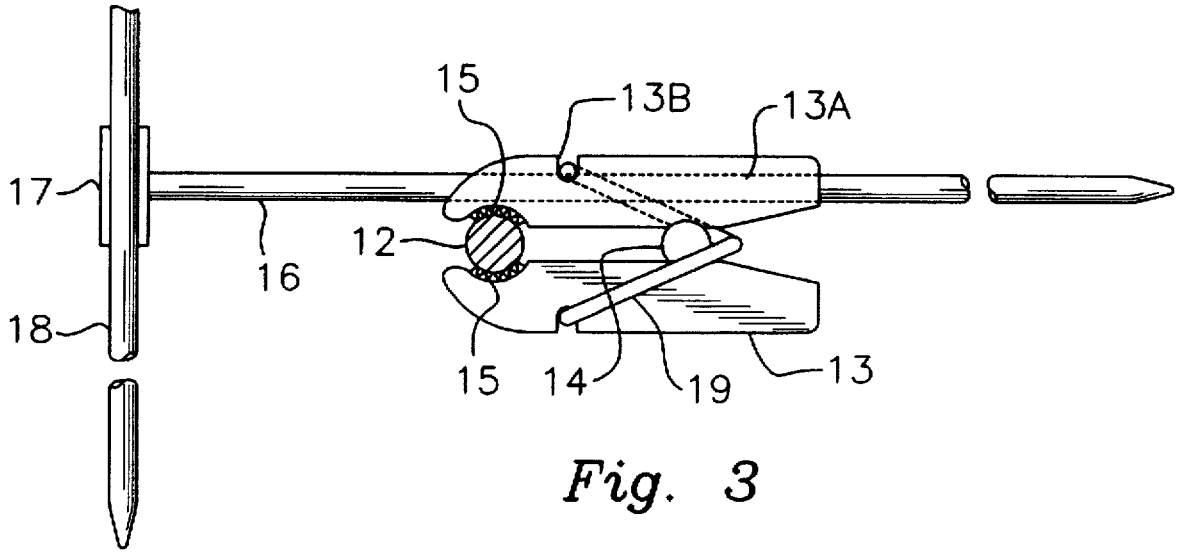
FIG. 3 shows a top view of the alignment device attached to the shaft of a typical putter. It also shows the pointer mounted in the positioning rod pointer holder. Additionally, it shows how the torsion spring secures the clamp halves together and also provides tension on the positioning rod to allow it to be moved (slid) forward or backward in the positioning rod guide on the side of the clamp. Also, the non-slip surface of each clamp half is shown where it contacts the putter shaft.

FIG. 3 shows both halves of the clamp 13 and how it is held together by means of the torsion spring 19 and spring retaining slot 13B. This view also shows how the clamp 13 is positioned on the putter shaft 12 with a non-slip concave area 15 to coincide with the round surface of the putter shaft 12. The non-slip surface effect can be enhanced by using a soft rubber or similar type material to coat this surface area. The clamp hinge 14 allows the clamp 13 to be opened at the front by pressing the rear part of the clamp 13 together. In the open position the clamp 13 can easily be moved to any desired position on the putter shaft 12 or putter hosel 12A and released to secure the clamp 13 in the new location. Also shown is the clamp positioning rod guide **13*a* which serves as a guide and a holder for the positioning rod to slide forward and rearward in the clamp 13. FIG. 3 also shows how the alignment pointer 18 fits into the positioning rod pointer holder 17 with maximum exposure of the alignment pointer 18 upper surface in order to provide minimum distraction to the golfer when using the device 10**.

The materials used for the construction of the clamp 13 and the positioning rod 16 would preferably be clear plastic to provide the minimum distraction to the golfer and also to provide a light weight device in order to minimize any change in the "feel" of the putter 11 or putter stroke. The alignment pointer 18 preferably would be a colored plastic that will contrast significantly with the other construction materials, the putter head 11B, the golf ball 20 and the putting surface 22. The contrasting alignment pointer 18 material will allow maximum visual observation of the pointer 18 position during the putting stroke. The above features individually and in combination are significant improvements over existing devices.

Figure 4:
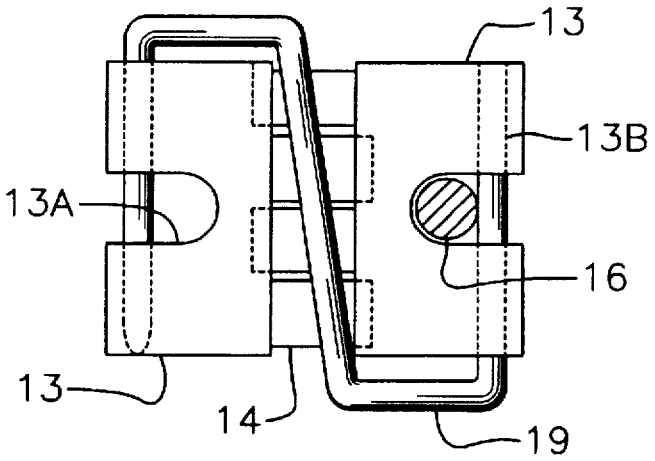
FIG. 4 shows a rear view of the clamp halves and how the clamp hinges join together and are held in place by the torsion spring. Additionally, it shows the positioning rod guides along each side of the clamp halves and how the torsion spring holds the positioning rod in place.

FIG. 4 shows a rear view of the clamp 13 halves, the positioning rod guides 13A along each side which allows the positioning rod 16 to be moved forward or rearward while being retained by the torsion spring 19; the torsion spring 19 and how it holds the two halves of the clamp 13 together along with the recessed spring retainer slot 13B on the exterior of the clamp 13 which retains the torsion spring 19 in proper position between the clamp 19 halves; and the clamp hinge 14 and how they mate together.

FIG. 5 shows illustrations of how the alignment pointer 18 is viewed by the golfer's eye 21 during the initial positioning and also during a short and a long backstroke. FIG. 5A shows the initial setup of the putter 11, the alignment device 10 attached to the putter shaft 12 at a low position and the golfer's line of sight directed at the golf ball 20 and the alignment pointer 18. FIG. 5B shows the putter 11 at a short backstroke position and how the golfer's eye 21 can still keep the line of sight 21A directed at the golf ball 20 while still keeping the alignment pointer 18 over the golf ball 20. FIG. 5C shows how, by attaching the alignment device 10 at a higher location on the putter shaft 12, that a longer backstroke can be made while still keeping the alignment pointer 18 in the golfer's line of sight 21A over the golf ball 20.

FIG. 6 shows how the alignment pointer 18 position, relative to the putting surface 22, can be changed by rotating the positioning rod 16 in the clamp 13. Changing positions by this means can aid a golfer in practicing puts when the aiming device 10 is mounted low on the putter shaft 12 or hosel 12A and just slightly above the golf ball 20.

I claim as my invention:

1. A golf putter alignment device, comprising:

a clamp having a leading end and a trailing end, said leading end being adapted to releasably engage a golf putter at a preselected position along a length of said golf putter;

said clamp having a first part and a second part;

a torsion spring for interconnecting said first and second parts of said clamp to one another and for biasing respective leading ends of said first and second parts toward one another;

said torsion spring having a first arm and a second arm;

an elongate groove formed in said first part of said clamp;

an elongate positioning rod disposed within said elongate groove;

said first arm of said torsion spring overlying said elongate positioning rod to retain said elongate positioning rod within said elongate groove, said elongate positioning rod being slideably displaceable and rotationally adjustable within said elongate groove;

a cradle-shaped holder secured to a leading end of said elongate positioning rod, said cradle-shaped holder being disposed transversely to a longitudinal axis of said elongate positioning rod;

an elongate alignment pointer disposed within and slideably supported by said cradle-shaped holder;

whereby a golfer may practice putting by inserting the elongate alignment pointer in the cradle-shaped holder at the leading end of the elongate positioning rod, sliding the elongate positioning rod to a preselected position within said elongate groove, attaching the clamp to a golf putter, holding a golf putter in a putting stance, and adjusting the respective positions of the clamp, the elongate positioning rod, and the elongate alignment pointer to preselected positions.

2. The device of claim 1, wherein said first and second arms of said torsion spring have free ends that are transversely disposed with respect to a longitudinal axis of said torsion spring, and further comprising a first transversely disposed groove formed in said first part of said clamp and a second transversely disposed groove formed in said second part of said clamp, said transversely disposed free ends of said first and second arms of said torsion spring being disposed within said first and second transversely disposed grooves, respectively.

3. The device of claim 2, wherein said first transversely disposed groove intersects said elongate groove so that said first transversely disposed arm of said first arm of said torsion spring abuts said elongate positioning rod that is disposed within said elongate groove.

4. The device of claim 1, wherein said preselected position along said length of said putter is a preselected position along a shaft of said putter.

5. The device of claim 1, wherein said preselected position along said length of said putter is a preselected position along a hosel of said putter.

* * * * *